US009301568B2

(12) United States Patent
Law

(10) Patent No.: US 9,301,568 B2
(45) Date of Patent: Apr. 5, 2016

(54) FLIP-FLOPS

(75) Inventor: Yuen Mou Law, Tsuen Wan (HK)

(73) Assignee: Magic Land Limited, Queensway (HK)

( * ) Notice: Subject to any disclaimer, the term of this patent is extended or adjusted under 35 U.S.C. 154(b) by 1089 days.

(21) Appl. No.: 12/685,135

(22) Filed: Jan. 11, 2010

(65) Prior Publication Data

US 2011/0167671 A1 Jul. 14, 2011

(51) Int. Cl.

| | |
|---|---|
| ***A43B 3/00*** | (2006.01) |
| ***A43B 3/12*** | (2006.01) |
| ***A43B 3/10*** | (2006.01) |

(52) U.S. Cl.

CPC *A43B 3/103* (2013.01); *A43B 3/126* (2013.01)

(58) Field of Classification Search

CPC ..... A43B 3/10; A43B 3/12; A43B 3/107; A43B 3/101; A43B 3/102; A43B 3/14; A43B 3/124; A43B 3/126; A43B 3/128; A43B 3/242; A43B 3/122; A43B 3/103

See application file for complete search history.

(56) References Cited

U.S. PATENT DOCUMENTS

| | | | | | |
|---|---|---|---|---|---|
| 3,928,927 | A * | 12/1975 | Brown et al. | 36/11.5 |
| 3,978,596 | A * | 9/1976 | Brown et al. | 36/11.5 |
| 4,172,330 | A * | 10/1979 | Kao | 36/11.5 |
| 4,525,940 | A * | 7/1985 | Mochizuki | 36/8.1 |
| 4,864,736 | A * | 9/1989 | Bierk | 36/11.5 |
| 5,185,942 | A * | 2/1993 | Decker | 36/11.5 |
| 5,499,460 | A * | 3/1996 | Bryant et al. | 36/43 |
| 5,802,738 | A * | 9/1998 | Ferniani | 36/11.5 |
| 6,442,869 | B2 * | 9/2002 | Coomes | 36/11.5 |
| 7,694,436 | B2 * | 4/2010 | Mullen | 36/11.5 |
| 8,132,342 | B1 * | 3/2012 | Moon | 36/101 |
| 8,151,491 | B2 * | 4/2012 | Sarantakos | 36/100 |
| 2005/0016018 | A1 * | 1/2005 | Cagner | 36/11.5 |
| 2007/0220777 | A1 * | 9/2007 | Richardson | 36/11.5 |
| 2008/0086825 | A1 * | 4/2008 | Mullen | 12/142 Q |
| 2009/0044423 | A1 * | 2/2009 | Amsterdam | 36/11.5 |
| 2010/0011623 | A1 * | 1/2010 | Seckler et al. | 36/136 |
| 2011/0239484 | A1 * | 10/2011 | Giovannetti | 36/11.5 |

* cited by examiner

*Primary Examiner* — Robert J Hicks
*Assistant Examiner* — Timothy K Trieu
(74) *Attorney, Agent, or Firm* — Raymond R. Ferrera; Adams and Reese LLP

(57) ABSTRACT

A flip-flop or slipper which has a sole that has holes for receiving the knobs on a strap. The holes are heat-treated to reduce the resilience of the sole material at the sides of the holes. This prevents the knobs from squeezing through the holes and thus prevents the strap from disengaging the sole.

4 Claims, 9 Drawing Sheets

FLIP-FLOPS

FIELD OF INVENTION

This invention pertains to footwear. More particularly, this invention pertains to flip-flops, also known as slippers.

BACKGROUND OF THE INVENTION

A flip-flop is assembled by drilling holes into a sole made of a flexible material and securing a moulded strap to the sole. The strap is shaped such that it comprises two elongate members joined at an angle. The adjoining portion of the elongate members has a knob. Either other end of the elongate members also has a knob. The knobs are pushed through the holes in the sole to provide the flip-flop.

When the flip-flop is worn, the wearer's foot is inserted in between the strap and the sole, such that the sole is secured to the foot by the strap. When the wearer walks, the strap may be tugged at in any direction along the plane of the sole, and also vertically from the plane of the sole, to pull away from the sole.

Quite easily, the knob is able to come free of the hole in the sole and the strap falls away from the sole.

Therefore, it is desirable to provide a flip-flop which has a strap more securely attached to the sole.

SUMMARY OF THE INVENTION

In a first aspect, the invention proposes a flip-flop comprising: a sole having an insole surface and an outsole surface, the sole being made of a resilient foam material having pockets of gas, the sole having through-holes, the outsole surface having depressions, the position of each depression being coincidental with the position of a through-hole, each depression being a cradle for holding a knob of the strap, a strap having knobs secured into the through-holes to hold the strap onto the insole surface, the foam material forming the sides of each depression being heat-pressed such that the foam material is compressed and the gas in the gas pockets are released, wherein the sides of each depression have reduced resilience relative to the rest of the sole.

In a second aspect, the invention proposes method of making a flip-flop comprising the steps of providing a sole having an insole surface and an outsole surface, the sole being made of a foam material having pockets of gas, providing a strap having at least one knob, die-cutting at least one through-hole in the sole for the respective at least one knob to be pushed through, heat-pressing on the at least one though-hole to form on the outsole surface at least one depression co-incidental with the at least one through-hole, inserting the at least one knob of the strap into a respective at least one through-hole, wherein the heat-pressing causes the foam material to be compressed and the gas in the gas pockets to be released, such that the sides of the at least one depression have reduced resilience relative to the rest of the sole.

Advantageously, this provides the possibility of having heat-formed holes on a flip-flop which is strengthened by the heating and pressing, to resist tugging forces on the strap when the flip-flop is worn. The foam material melts during the heating and the pressing releases the gas in the gas pockets. This causes the foam material defining the depressions to be compressed and has a greater density the rest of the sole. Thus, the sides of the depressions are less resilient and do not deform to allow the knobs of the straps from squeezing back through the holes in the sole. Thus, the strap is prevented from detaching from the sole easily.

BRIEF DESCRIPTION OF THE FIGURES

It will be convenient to further describe the present invention with respect to the accompanying drawings that illustrate possible arrangements of the invention, in which like integers refer to like parts. Other arrangements of the invention are possible, and consequently the particularity of the accompanying drawings is not to be understood as superseding the generality of the preceding description of the invention.

DETAILED DESCRIPTION OF THE INVENTION

Figure 1:
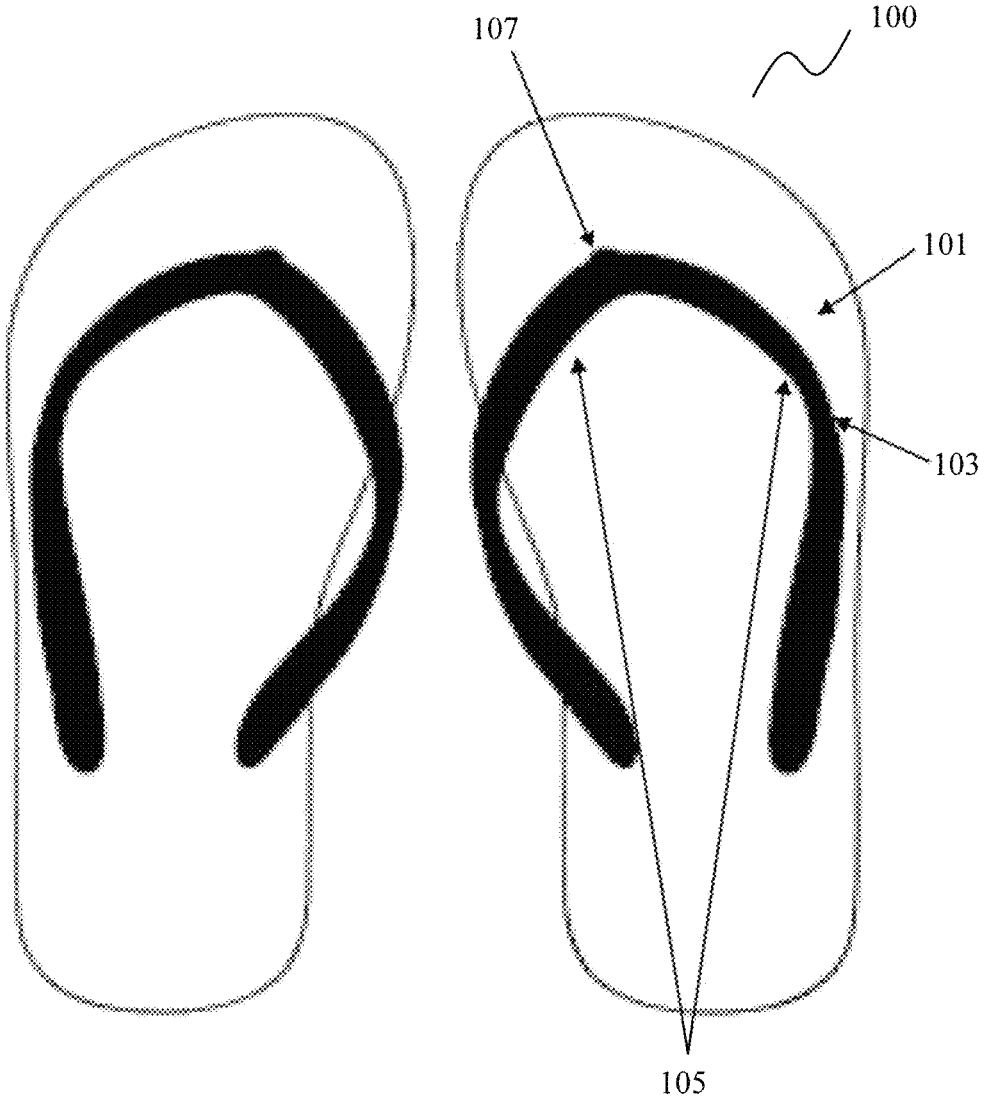
FIG. 1 is a plan view of an assembled embodiment according to the invention.

FIG. 1 shows a pair of flip-flops 100. Each flip-flop is assembled of a sole 101 and a strap 103, wherein the strap 103 has knobs which are secured to holes in the sole 101.

Figure 2:
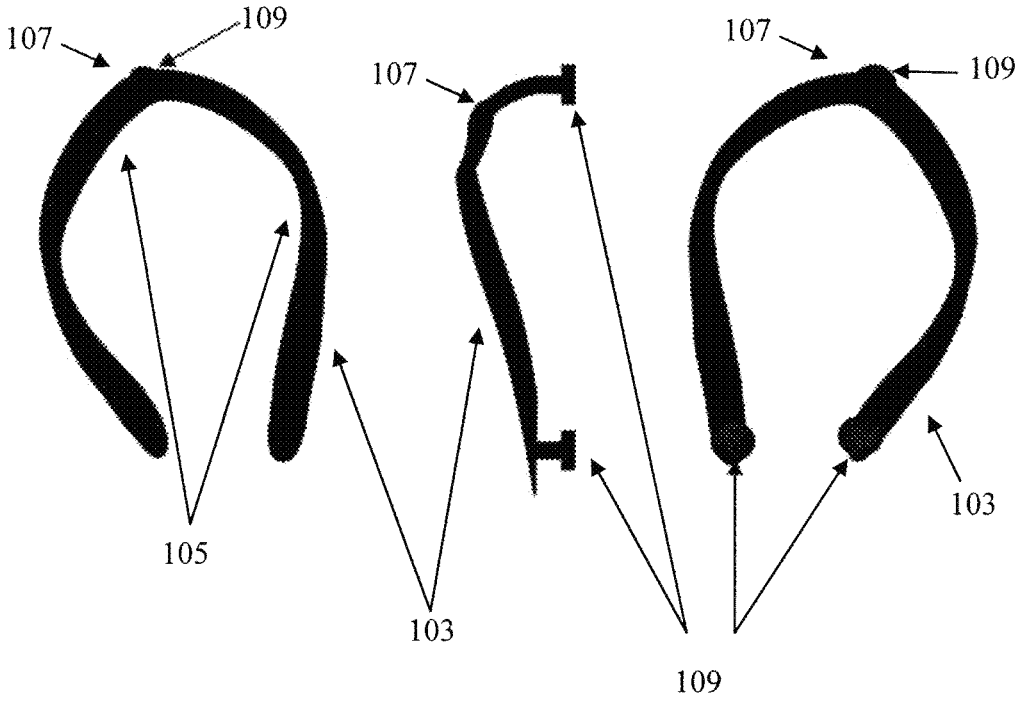
FIG. 2 is view of a part of the embodiment of FIG. 1.

FIG. 2 illustrates the strap 103 without the sole 101, showing the plan, side and bottom views of the strap 103. It can be seen that the strap 103 comprises two elongate members 105 joined at one end of each member 103 at an angle. This provides an adjoining portion 107, forming a Y-shape strap 103. The adjoining portion 107 has a protruding knob 109 for securing the strap 103 to the sole 101. The other end of each of the elongate members 105, which extends away from the joining portion 107, also has a knob 109. Thus, there are three knobs 109 in the Y-shape strap 103. Typically, the strap 103 is moulded from a flexible plastic material such as polyvinyl chloride (PVC).

Figure 3:
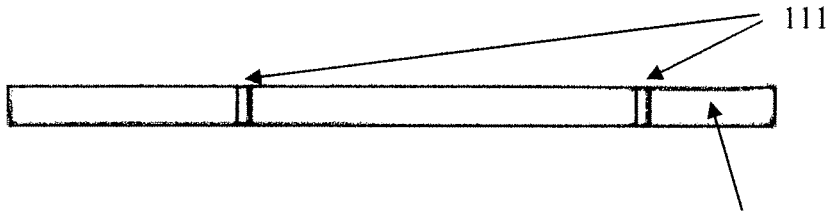
FIG. 3 is a cross-sectional side view of the embodiment of FIG. 1.

FIG. 3 shows a cross-sectional the side view of the sole 101 without the strap 103, which is cut from a piece of resilient foam material such as a piece of polymer foam and shaped to be a flip-flop sole.

Figure 3A:
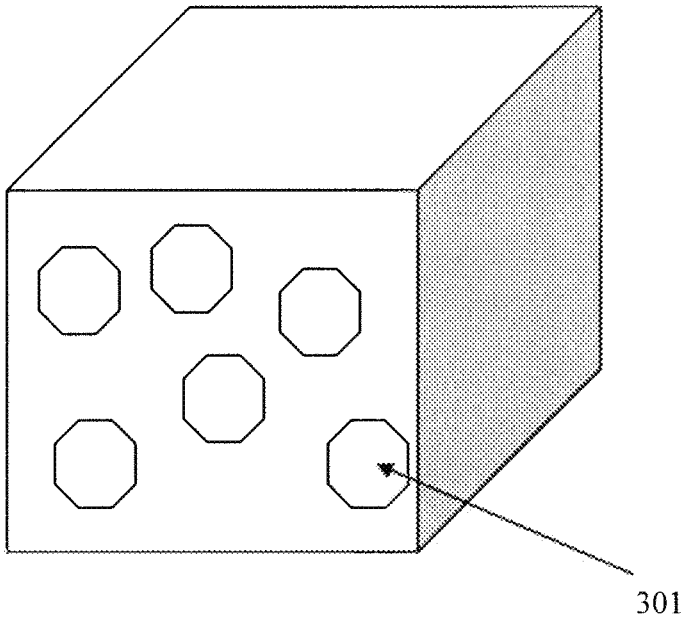

FIG. 3*a* illustrates that the resilient foam material contains many gas pockets, which are usually filled with air. The resilience of the foam material and the gas pockets together allow the foam to be shape resilient, and provide suitable cushioning effect to the wearer's foot. An example of such a material is ethyl vinyl acetate (EVA).

Figure 4:
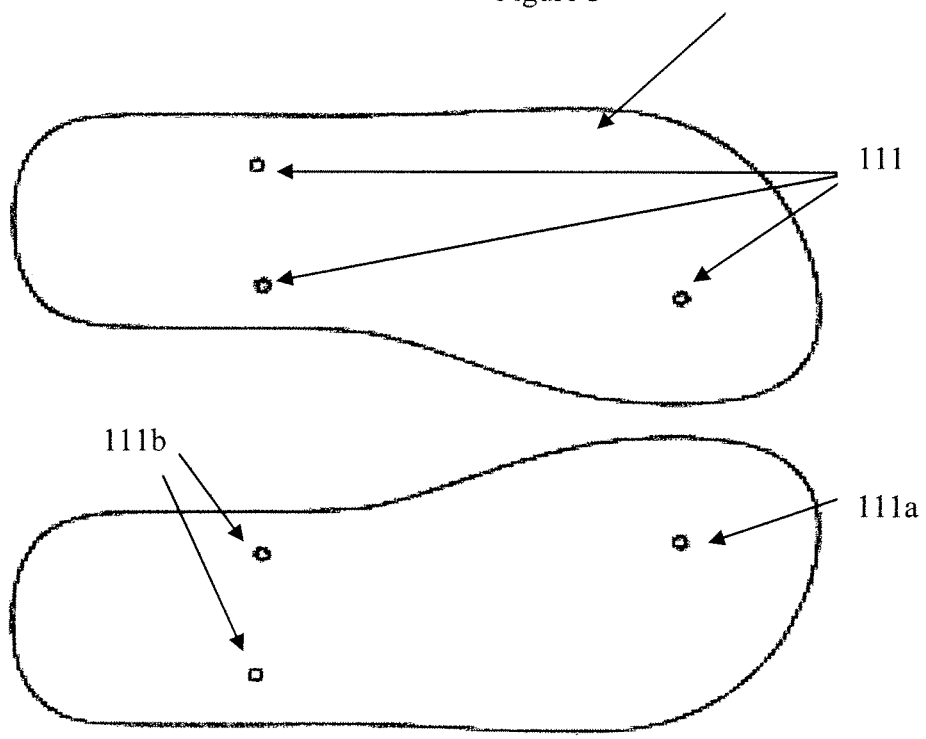
FIG. 4 is a plan view corresponding to the side view of FIG. 3.

The sole is then die-cut to provide through-holes 111 in the sole. FIG. 4 is a corresponding plan view of the sole 103, showing that the sole 101 has three holes 111 for receiving the respective knobs 109 of the strap 103. One through-hole 111*a* is located at the part of the sole 101 where the wearer's toes are supposed to be placed when the flip-flop 100 is worn. There are two further holes 111*b*, one at either side of the sole 101 next to where the arch of the foot should be placed when the flip-flop 100 is worn. Each through-hole 111 extends from one surface of the sole to the other surface.

Figure 5:
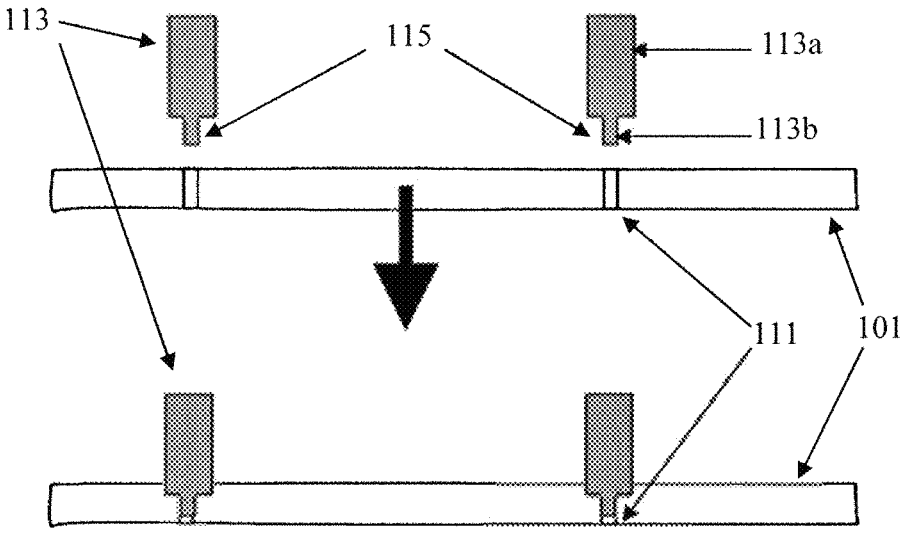
FIG. 5 illustrates a process for making the part of embodiment shown in FIG. 3.

FIG. 5 illustrates a heat-pressing treatment on the sole 101. The holes 111 in the 101 are heat pressed using a heat press 113. The heat pressing is done on the surface of the sole that is intended to be the outsole 101*b*. The opposite surface of the sole 101 is therefore the insole 101*a*.

The heat press 113 is generally made up of a main body 113*a* and a protrusion 113*b* which extends from the main body 113*a*. Typically, the main body 113*a* is an elongate member with a circular cross-section of a certain diameter (cross-section view not provided). Extending from the end of the main body 113*a* is the protrusion 113*b*, which has a smaller diameter than the main body 113*a*. Preferably, the protrusion is axially aligned with the main body 113*a*.

The heat press 113 is heated to a suitably high temperature and aligned such that the protrusion 113*b* points at a through-hole 111 in the sole 101. The smaller diameter of the protrusion 113*b* allows the protrusion 113*b* to fit into the die-cut through-holes 111 in the sole 101. However, the larger diameter of the main body 113*a* of the heat press 113 is unable to enter into the die-cut through-hole 111. Thus, when the heat press 113 is pressed onto the sole 111, the main body presses against the outsole surface of the sole 101.

Figure 6:
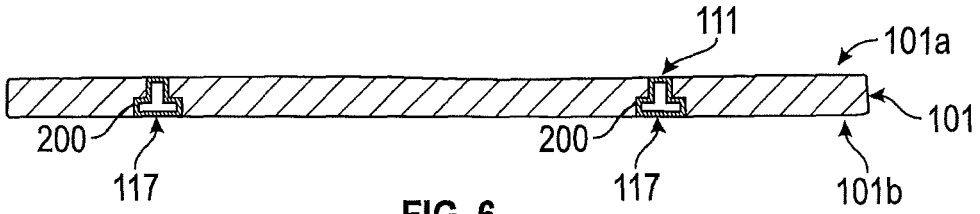
FIG. 6 is a cross-sectional view of the part of embodiment shown in FIG. 3, after the process illustrated in FIG. 5.
Figure 7:
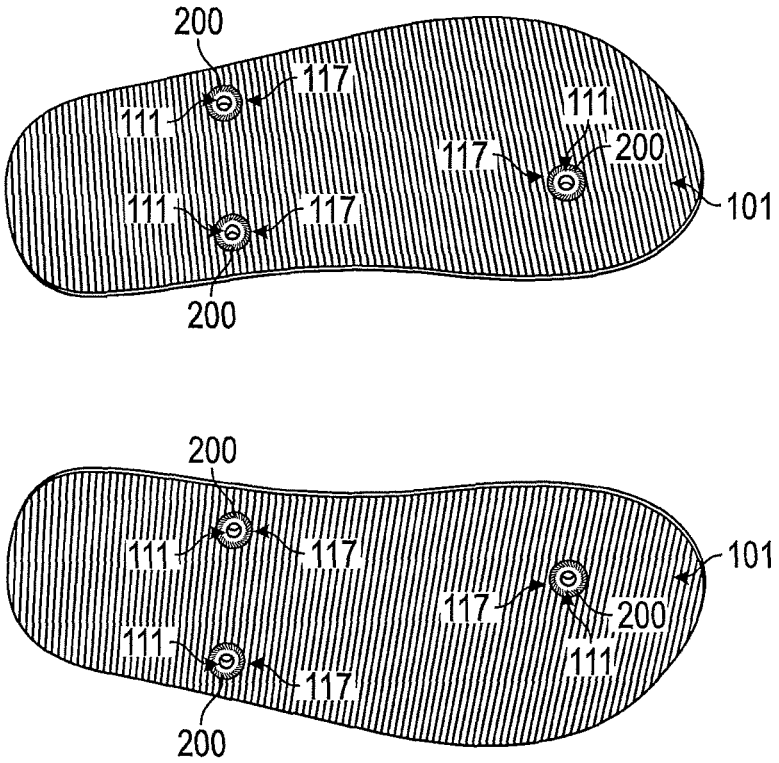
FIG. 7 is a plan view corresponding to FIG. 6.

The heat and pressure applied by the man body 113*a* to the sole 101 are predetermined such that the heat and pressure cause a depression 117 to be heat-formed on the sole 101. Unlike the die-cut through-holes 111, the depression 117 created by the heat press 113 is not a through-hole and has a depth which is only a fraction of the thickness of the sole. This is illustrated in FIG. 6 which shows the side view, and FIG. 7 which shows the plan view. The depression 117 is shaped like an inverted 'T' when the sole is placed with the insole surface facing up. The depression 117 has a diameter according to the diameter of the main body 113*a*. The depth of the depression 117 depends on the extent to which the heat press 113 is pressed into the sole 101. Generally, the dimensions of the depression 117 are designed for receiving and cradling a knob 109 of the strap 103. It is optional whether all three through-holes are heat pressed to form three depressions 117 simultaneously or in sequential order.

The top two drawings in FIG. 5 shows the sole 101 placed upside down to facilitate the heat-pressing, while FIG. 6 shows the sole 101 placed with the insole 113*a* surface facing up.

To assemble a flip-flop, the strap 103 is placed on the side of the sole 101 which should form the insole of the flip-flop and each knob 109 is pushed through the respective through-holes 111 to emerge from the side of the sole 101. Thus, the through-holes also serve the purpose of guiding the knobs through the sole 101. The depression 117 then provides a sort of cradle (a semi-spherical form) into which the knob 109 of the strap 103 fits.

More specifically, the knob 109 at the joining portion of the strap 103 is pushed through the through-hole 111*a* where the wearer's toes should lie. The knobs 109 at the free ends of the elongate members 105 of the strap 103 are pushed through the respective through-holes 111*b* at the sides of the sole 101, next to where the arch of the wearer's foot should be.

Figure 8:
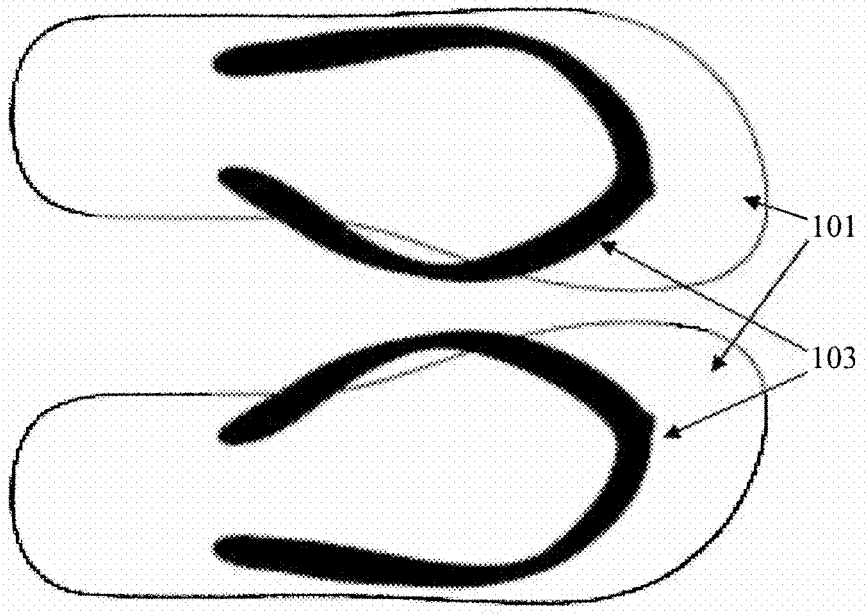
FIGS. 8, 9 and 10 are the top, bottom and side elevation views of the assembled embodiment of FIG. 1.
Figure 9:
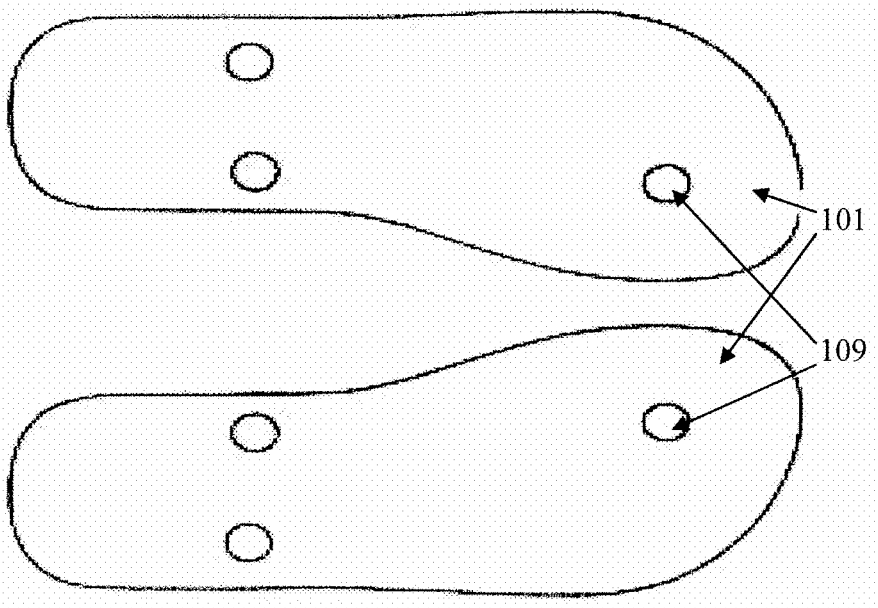
Figure 10:
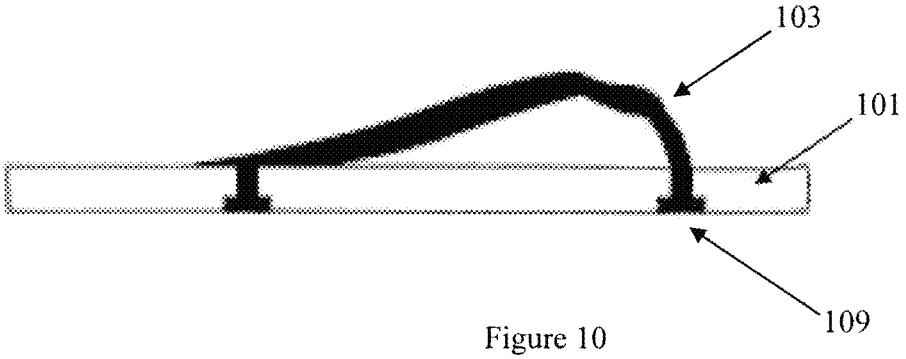

Naturally, the flip-flops must be assembled as a pair. FIGS. 8 to 10 shows the assembled flip-flops 100. When the wearer's foot is slipped between the strap 103 and the sole 101, the strap 103 securely holds the sole 101 to the wearer's foot. The knob at the adjoining part of the strap 103 is usually held between the first and second toes of the wearer.

The heat treatment causes the part of the sole 101 forming the sides of the depressions 117 to be hardened 200. As EVA is a foam material, the heat melts the EVA while releasing the gas in the gas pockets. Subsequently, the EVA material is allowed to cool quickly, so that the shape of depressions is stabilised and maintained. The process therefore reduces the volume and increases the density of the EVA around the depressions 117. As a result, the EVA forming the sides of the depressions becomes less resilient, and does not deform easily under pressure. The rest of the soles 101 retains the resilience and cushioning effect for the comfort of the wearer.

Figure 11:
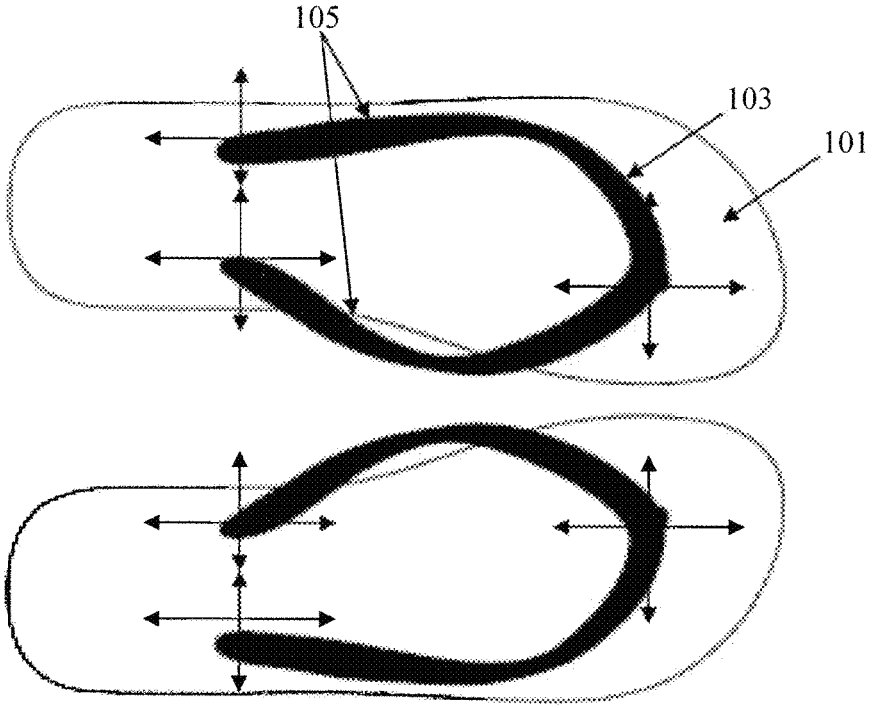
FIGS. 11 and 12 show the forces acting on the embodiment of FIG. 1 when in use.

This resistance to deformation prevents a knob from squeezing back from the depression through the through-hole, to detach from the sole 101. Accordingly, a knob 109 cradled in a depression 117 is more securely held to the sole 101 despite forces pulling the strap 103 away from the sole 101. The arrows in FIG. 11 illustrate tugging forces on the strap 103 in different directions but the heat-pressed depressions are able to resist the forces and does not allow the knobs 109 of the strap 103 to squeeze free of the sole easily.

Figure 12:
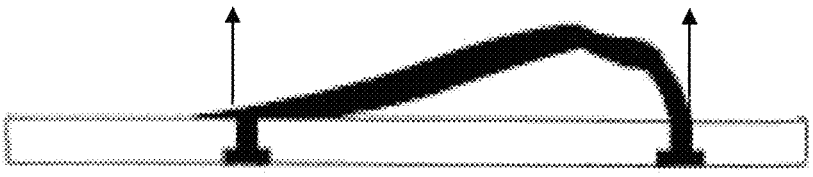

Similarly, the arrows in FIG. 12 show how the heat-pressed foam around the depressions 111 is able to hold onto a knob 109 despite a pull on the strap 103 in the direction perpendicular to the plane of the sole 101.

The skilled man understands that a foam made of a material other than EVA with similar properties may be used for the sole, as long as the material can be compressed by heat alone, pressure alone, or both heat and pressure, to the extent that the local part of the foam defining the depressions becomes relative less resilience. This prevents the depressions from deforming to give way to a knob 109 in detaching from the sole 101.

Therefore, the embodiment is a flip-flop 100 comprising: a sole 101 having an insole 101 surface and an outsole 101 surface, the sole 101 being made of a resilient foam material having pockets of gas, the sole 101 having through-holes 111, the outsole 101 surface having depressions 117, the position of each depression 117 being coincidental with the position of a through-hole 111, each depression 117 being a cradle for holding a knob of the strap 103, a strap 103 having knobs secured into the through-holes 111 to hold the strap 103 onto the insole 101 surface, the foam material forming the sides of each depression 117 being heat-pressed such that the foam material is compressed and the gas in the gas pockets are released, wherein the sides of each depression 117 have reduced resilience relative to the rest of the sole 101.

Therefore, the embodiment is includes a method of making a flip-flop 100 comprising the steps of providing a sole 101 having an insole 101 surface and an outsole 101 surface, the sole 101 being made of a foam material having pockets of gas, providing a strap 103 having at least one knob, die-cutting at least one through-hole 111 in the sole 101 for the respective at least one knob to be pushed through, heat-pressing on the at least one though-hole to form on the outsole 101 surface at least one depression 117 co-incidental with the at least one through-hole 111, inserting the at least one knob of the strap 103 into a respective at least one through-hole 111, wherein the heat-pressing causes the foam material to be compressed and the gas in the gas pockets to be released, such that the sides of the at least one depression 117 have reduced resilience relative to the rest of the sole.

Thus, the embodiment is a flip-flop or slipper which has a sole 101 that has through-holes 111 for receiving the knobs 109 on a strap 103. The through-holes 111 are heat-treated to strengthen or harden the sole material at the edge of the though holes 111. This prevents the through-holes from being deformed easily and prevents the knobs 109 which have penetrated from one side of the sole 101 through the through-holes 111 to the other side from squeezing back through the through-holes 111, and thus prevents the strap 103 from disengaging the sole 101.

While there has been described in the foregoing description preferred embodiments of the present invention, it will be understood by those skilled in the technology concerned that many variations or modifications in details of design, construction or operation may be made without departing from the scope of the present invention as claimed.

For example, foam made of a material other than EVA and can be treated in the same way as described can be used.

The invention claimed is:

1. A flip-flop comprising:

a sole having an insole surface and an outsole surface, the sole being made of a substantially resilient foam material having pockets of gas;

the sole having through-holes;

a strap having knobs secured into the through-holes to hold the strap onto the insole surface;

the outsole surface having depressions positioned coincidental with positions of the through-holes, each depression being a cradle for holding each knob of the strap;

wherein, the foam material forming the sides of each depression has a greater hardness than the foam material of the rest of the sole, so as to prevent each depression from deforming such that each knob detaches from the sole.

2. The flip-flop as claimed in claim 1 wherein the sole is made of ethyl vinyl acetate.

3. A flip-flop, comprising:

a sole having an insole surface and an outsole surface, the sole being made of a substantially resilient foam material having pockets of releasable gas;

the sole having at least one through-hole;

a strap having at least one knob secured into the at least one through-hole to hold the strap onto the insole surface;

the outsole surface having at least one heat-pressed depression positioned coincidental with a position of the at least one through-hole, the at least one depression being a cradle for holding the at least one knob of the strap;

wherein the foam material forming the sides of the at least one depression has a greater compression and hardness than the foam material of the rest of the sole, so as to prevent the at least one depression from deforming such that the at least one knob detaches from the sole.

4. The flip-flop as claimed in claim 3, wherein the sole is made of ethyl vinyl acetate.

* * * * *